United States Patent [19]

Calder

[11] Patent Number: 4,483,481

[45] Date of Patent: Nov. 20, 1984

[54] SPRAY TIP

[75] Inventor: Oliver J. Calder, Orange, Calif.

[73] Assignee: Phyllis Graham, Orange, Calif.

[21] Appl. No.: 442,525

[22] Filed: Nov. 18, 1982

Related U.S. Application Data

[63] Continuation of Ser. No. 165,247, Jul. 2, 1980, abandoned.

[51] Int. Cl.[3] ..... B05B 15/02

[52] U.S. Cl. ..... 239/119; 239/288.3; 239/600

[58] Field of Search ..... 239/119, 288, 288.3, 239/600, DIG. 22; 251/312, 368; 277/235 R, 235 A, 188 A

[56] References Cited

U.S. PATENT DOCUMENTS

| | | | |
|---|---|---|---|
| 3,202,360 | 8/1965 | O'Brien | 239/119 |
| 3,627,334 | 12/1971 | Reddy | 277/235 A |
| 3,709,256 | 1/1973 | Gore et al. | 251/312 |
| 3,918,495 | 11/1975 | Abrahams | 251/368 |
| 4,116,386 | 9/1978 | Calder | 239/119 |
| 4,165,836 | 8/1979 | Eull | 239/119 |
| 4,256,260 | 3/1981 | Piggott | 239/119 |

FOREIGN PATENT DOCUMENTS 1152441 2/1958 France .

*Primary Examiner*—Andres Kashnikow
*Assistant Examiner*—Michael J. Forman
*Attorney, Agent, or Firm*—Robert E. Strauss

[57] ABSTRACT

There is disclosed an improved spray tip particularly suited for airless pressured spraying utilizing a spray orifice member in a removeable turret member that can be rotated to reverse the orifice for cleaning. The design overcomes difficulties with prior art spray tips of this construction by the use of a thin resilient seal which is located between the turret member and a seal support which is compressed in the assembly. The use of the thin seal achieves a fluid tight seal that prevents leaking even of low viscosity liquids while avoiding the seizure problems which have characterized plastic seals of prior devices. The turret member is removeable without disassembly of the spray tip or its guard, thereby permitting facile interchanging of turret members with differently sized orifices.

7 Claims, 6 Drawing Figures

SPRAY TIP

This is a continuation of application Ser. No. 165,247 filed July 2, 1980, now abandoned.

BACKGROUND OF THE INVENTION

In my prior U.S. Pat. No. 3,831,862, I disclosed a spray tip assembly in which the spray tip orifice is mounted in a removeable and reversible sleeve which is secured in the housing with a sliding pin interlock. This construction requires loosening of the body from its adapter to reverse the spray tip orifice.

In my prior U.S. Pat. No. 4,116,386, I disclosed a spray tip assembly in which the spray tip orifice is mounted in a cylindrical turret member which can be rotated in the housing to reverse the orifice member for cleaning. This construction employs a solid, resilient plastic seal which has a cylindrical concave face conforming to and mating with the cylindrical surface of the turret member.

A recently issued patent, U.S. Pat. No. 4,165,836, discloses that solid plastic seals experience excessive wear and suggest that an entirely metal seal be used to provide metal-to-metal contact between the seal and turret member. Experience with devices of this invention, however, reveals that the metal seal in not effective with low viscosity liquids which leak from the assembly under the high pressures used in airless spraying.

Accordingly, it is desirable to provide a spray tip with a reversible orifice having a seal construction which obviates the prior art difficulties with solid plastic seals and which, nevertheless, achieves tight sealing even with low viscosity liquids. It is also desirable that the spray tip permit a simple removal and interchanging of the spray orifice without disassembly of the other parts of the spray tip.

BRIEF STATEMENT OF THE INVENTION

This invention comprises a spray tip having a housing with a longitudinal through passageway and a cylindrical through bore orthogonal to and intersecting the through passageway. A cylindrical turret member, which has a transverse through bore in which is seated an orifice member, is seated in the cylindrical through bore. The turret member has a dependent handle and an annular flange, the latter captured by a prong on the housing body. The flange has a slot which can be aligned with the prong to permit removal of the turret member. The longitudinal through passageway receives a hard surface seal support which has a central through passageway and a cylindrically concave sealing surface. A thin film seal having a thickness from about 0.001 to about 0.1 inch and formed of a plastic is captured between the hard metal surface of the turret member and the hard surface of the seal support. The invention also includes a cap nut and T-seal for axially compressing the seal support and seal against the cylindrical surface of the turret member thus firmly sealing the assembly. The assembly can also include a spray guard, preferably formed of plastic, and having diverging wings that shield the discharge from the spray tip.

It has been found that the use of the thin film seal obviates the problems encountered in the prior attempts in that the thin film seal does not have adequate thickness to extrude or cold flow and the difficulty of seizing which is sometimes experienced with solid plastic seals is eliminated. A plastic having a low coefficient of friction is used and the turret member can be rotated to reverse the spray orifice without loosening the assembly and releasing the compression on the seal. The thin film seal, however, forms a permanently tight seal against the turret member which does not leak with low viscosity liquids and which does not prevent rotation of the turret member to reverse the orifice tip for cleaning. The turret member can be removed simply by loosening the cap nut to release the seal compression, and aligning the slot of the turret flange to the prong.

BRIEF DESCRIPTION OF THE DRAWINGS

The invention will be described with reference to the figures of which.

DESCRIPTION OF THE PREFERRED EMBODIMENTS

Figure 1:
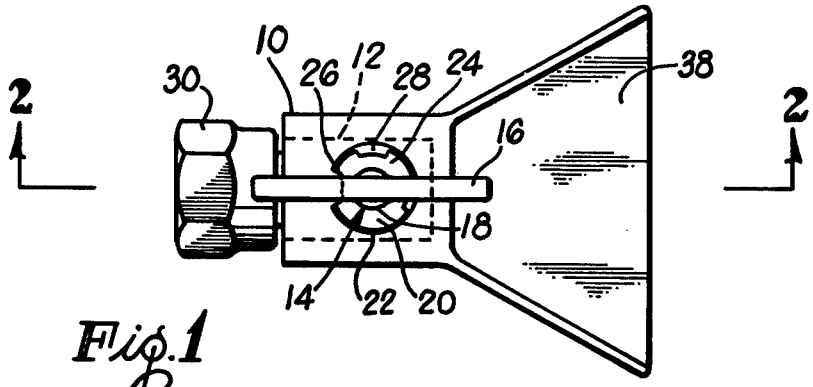
FIG. 1 is a view of the top side of the spray tip of the invention.

Referring now to FIG. 1, the invention is shown in a view of its top surface. As there illustrated, a spray guard 10 is mounted on a housing body 12 which supports a turret member 14. The turret member has a dependent handle 16 on shaft 18 which extends to a cylindrical turret member described in detail hereinafter. The turret member 14 has an annular flange 20 with a wide section 22 and a more narrow section 24. The body has a prong 26 which overlies the annular flange 20 to secure the turret assembly. The annular flange section 24 has a slot 28 which, when rotated beneath the prong 26 permits the extraction of the turret member.

The spray tip assembly is retained on the externally threaded barrel of a spray gun by the retainer nut 30. Tightening of this nut on the threaded barrel of the spray gun axially compresses the internal seals of the assembly in a manner described in greater detail hereinafter.

Figure 2:
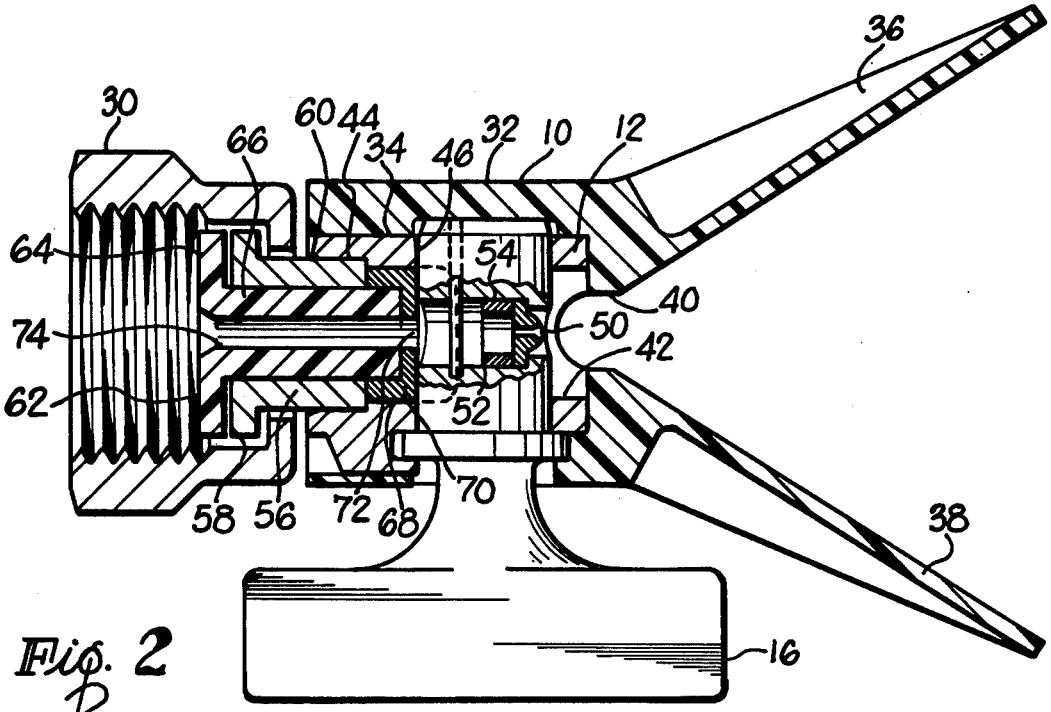
FIG. 2 is a sectional elevational view of the spray tip.

Referring now to FIG. 2, the spray tip assembly is shown in greater detail. As there illustrated, the spray guard 10 has a body 42 with a central cavity 34 that fits over the body 12 of the spray tip housing. The spray guard 10 has a pair of outwardly diverging wings 36 and 38 which are generally trapezoidal in shape as apparent from FIG. 1. At the apex or intersection of wings 36 and 38, the spray gun has a slot 40 to provide clearance for the spray discharge from the spray tip.

The body 12 of the housing of the spray tip has a longitudinal through passageway 42 which is counterbored at 44. The housing also has a cylindrical bore 46 orthagonal to and intersecting the through passageway 42 and this cylindrical bore 46 receives the cylindrical turret member 48. The latter has a transverse bore 50 which is counter bored at 52 to receive a spray tip orifice member 54. The orifice member 54 is firmly seated against the annular shoulder between bore 50 and counterbore 52 and is secured by sleeve 53 which is pressed into counterbore 52. Bore 50 should be of sufficient length that the orifice tip 54 does not project beyond the cylindrical surface of turret member 48.

The housing body 12 is secured to the retaining nut 30 by sleeve 56 which has an annular rim 58 that is received within the retainer nut 30. The assembly is permanently secured by inserting sleeve 56 into counter bore 44 and brazing, soldering or welding the assembly at 60.

The assembly is provided with a solid plastic T-seal 62 which has an annular flange 64 that overlies the face of flange 58 of sleeve 56. The T-seal has a sleeve body 64 that extends through sleeve 56 and is received in counter bore 68 of the seal support 70. The latter has a central bore 72 which is in alignment with the through passageway 74 of the T-seal 62.

The construction and shape of the seal support and thin layer seal is described in greater detail with reference to FIGS. 3 and 4.

Figure 3:
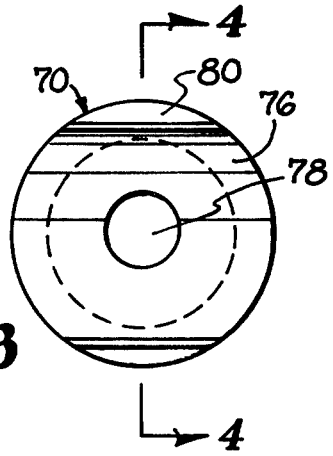
FIG. 3 is a view of the seal support and thin layer seal used in the invention.

Referring now to FIG. 3, there is illustrated the forward, sealing face of the assembly of seal and seal support. As there illustrated, seal 76 has a cylindrical concavity with a central aperture 78. The thin layer seal 76 is mounted on seal support 80.

Figure 4:
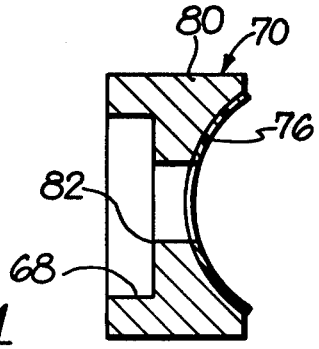
FIG. 4 is a sectional view along lines 4—4 of FIG. 3.

The seal support 80 has a cylindrical outer contour as shown in FIGS. 3 and 4 and also has a cylindrical concavity to receive and support the thin layer seal 76. The assembly of the spray tip on a spray gun and tightening of the retainer nut 30 on the threaded barrel of the spray gun applies an axial compression to the seal assembly. The end of the spray gun barrel is forcefully compressed on the face of flange 64 of the T-seal and this force is transmitted through the sleeve 66 and against shoulder 82 (FIG. 4) of the counter bore 68 of seal support 80. This force compresses the thin layer seal 76 against the cylindrical turret member 48, insuring a secure seal of the assembly. Since the thin layer seal 76 is preferably formed of a plastic having a relatively low coefficient of friction, e.g., Delrin, Teflon, etc., the turret member can be readily rotated by hand to reverse the position of the spray orifice in the assembly without releasing the seal compression, and repeated rotation of the turret member will not wear the thin layer seal 76. The thin layer seal 76 is also sufficiently thin, e.g., from about 0.001 to 0.1 inch, preferably from about 0.001 to about 0.005 inch, so that no significant extrusion of the plastic occurs even upon prolonged periods of compression. Accordingly, the invention is free of the objectionable seizure which can occur when an entirely plastic-body seal is employed.

The thin layer seal 76 can be permanently bonded to either the seal support 80 or to the cylindrical surface of the turret member 48. For this purpose, a thin layer of Teflon powder can be applied as a coating over the opposed surfaces of either of these members and heat treated to obtain a baked resin coating of the specified thickness. Alternatively, the thin layer seal can be an interchangeable member which is molded or formed into the necessary configuration to seat between the metal seal support 80 and turret member 48.

Figure 5:
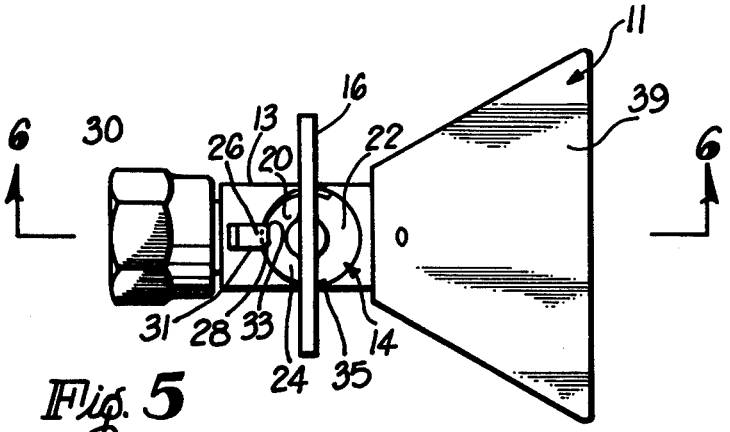
FIG. 5 is a partial top view of the spray tip with a different guard.
Figure 6:
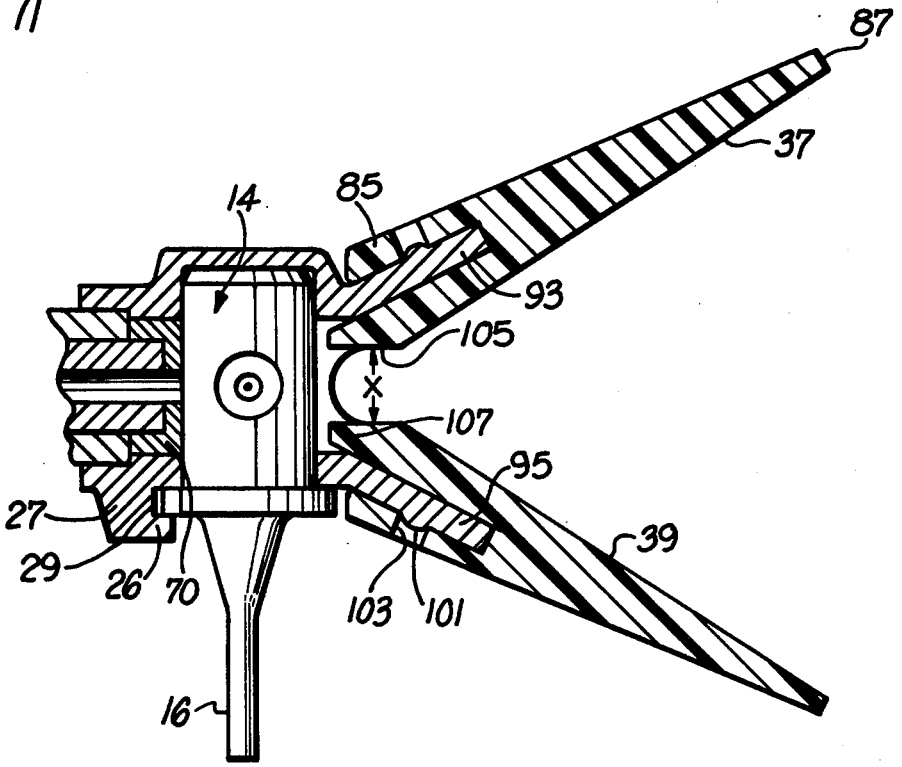
FIG. 6 is a partial sectional elevational view of the spray tip of FIG. 5.

Referring now to FIGS. 5 and 6, the invention is shown with an alternative spray guard, generally indicated at 11. The spray guard is formed of two, separate and outwardly diverging wings 37 and 39 which are generally trapezoidal in shape as apparent from FIG. 5. The spray guards can have a tapered cross section, as generally shown in FIG. 6 with a thick base 85, tapering to a thin outer edge 87.

The body 13 of the housing of the spray tip has a pair of forwardly projecting blades 93 and 95 which are flared outwardly at an angle from about 40 to 60 degrees, preferably from about 48 to 54 degrees.

The wings 37 and 39, which are formed of injection molded plastic, are molded with slots 97 and 99 to receive, respectively, blades 93 and 95. Each blade has a raised spherical bead 101 which is received in a coacting aperture 103 of the respective wing, serving as a detent to retain the spray guard wings in the assembly.

The inside surfaces of the wings have a beveled edge 105 to provide a slot there between having a width X, providing clearance for the spray from the tip assembly. The inside edge of the spray guard wings can have a lip 107 which projects into the throat of the body 13 of the spray tip housing.

Referring now to FIG. 5, the handle 16 of the turret member 14 has been rotated into the extraction position for the turret member. In this position, slot 28 in annular flange 20 is directly beneath the prong 26 of the body 12. The turret member will not become dislodged from the assembly in this position, so long as the retainer nut 30 remains tight on the barrel of the spray gun, maintaining compression on the seal support member 70 and the resilient, thin face seal 76. Loosening of the retainer nut 30, however, releases this compression and the turret member 14 can then be freely extracted from the assembly to be replaced with interchangeable turret members having the same or different size orifice tips 50.

As shown in FIG. 6, the prong 26 is dependent from the raised boss 27 on body 13 of the housing. The slot 29 which is formed by these members is a sufficient depth to receive the narrow flange portion 24 of the flange 20 on turret member 48 but of insufficient depth to receive the widest flange portion 22. In the fashion, the opposite sides of the boss 27, shown as 31 and 33 in FIG. 5, serve as abutment stops which coact with the shoulders 35 of flange 20, limiting the rotation of the turret member 48 and thus aligning the through passageway of the turret member to the through passageway of the spray tip assembly, indexing the orifice tip in both the spraying and cleaning or reversed positions.

The spray tip assembly of either embodiment can be provided with a plurality of interchangeable turret members with varied sizes of orifice tips. The orifice tips can be provided in sizes from about 0.005 to about 0.075 inch in any varied increments, preferably in increments from about 0.001 to 0.003 inch. These orifice tips will provide a fan spray with a width from 2 to about 22 inches in approximately 2 inch increments.

The embodiment shown in FIGS. 5 and 6 provides a spray tip having a spray guard which cannot be readily removed. Plastic spray guards as commonly used are often removed or the plastic guards are cut from the assembly. The removal of the plastic wings 37 and 39 of this embodiment, however, will not entirely eliminate the protective guards since the metal blades 93 and 95 of the housing will still be in tact and will still provide protection against accidents with the spray.

The invention provides a number of definite advantages over prior spray tips. The plastic seal of the invention tightly seals against leakage even with low viscosity liquids such as water. The metal or rigid seal support, however, firmly supports the seal and insures that the seal does not seize the turret member and prevent its rotation by hand since the seal is sufficiently thin that it does not exhibit any tendency to cold flow or extrude under the applied pressure. The turret member is easily removable from the spray tip simply by loosening retainer nut 30 and rotating the turret member to align the slot in its annular flange with the prong of the housing body. This permits a rapid replacement of the turret member without requiring any disassembly of the other members of the spray tip.

The seal support is preferably formed of metal, although any other hard and durable material can be used such as ceramic, graphite, etc. Preferably, the seal support and the turret member are formed of a corrosion resistant metal such as stainless steel.

The invention has been described with reference to the illustrated and presently preferred embodiment. It is not intended that the invention be unduly limited by this disclosure of the presently preferred embodiment. Instead, it is intended that the invention be defined by the means, and their obvious equivalent, set forth in the following claims.

What is claimed is:

1. A spray tip comprising:

a housing having a longitudinal through passageway and an intersecting othogonal cylindrical bore;

a spray guard having a pair of outwardly diverging wings dependent from a spray guard body having a central cavity receiving said housing thereby forming a housing and spray guard subassembly and an aperture in said spray guard body aligned with said intersecting cylindrical bore with at least one lip member dependent on said housing and spray guard subassembly;

a cylindrical turret member having an integral handle and rotatably seated in said intersecting cylindrical bore and extending through said aligned aperture of said spray guard body and having a transverse bore in alignment with said through passageway;

a spray tip orifice member mounted in said transverse bore;

a discontinuous annular flange on said turret member;

said lip member overlying and capturing said flange thereby securing the assembly of spray guard, housing and turret member; and the discontinuous portion of said annular flange being of sufficient size to pass said lip member when aligned therewith and permit removal of said turret member.

2. The spray tip of claim 1, including a Teflon plastic seal in said longitudinal through passageway of said body having a uniform thickness from 0.001 to 0.005 inch sufficient to resiliently seal but insufficient to extrude by cold flow, when compressed between said turret member and said seal support, a hard surface seal support received in said longitudinal passageway and having a central through passage and a cylindrical concave seal support surface bearing against said plastic seal, and means to compress said seal against said turret member.

3. The spray tip of claim 2 wherein said housing has a dependent sleeve bearing an annular flange which is received within a retainer nut to secure said spray tip to the barrel of a spray gun.

4. The spray tip of claim 3 including a T-seal having a sleeve for compressing said plastic seal, and received through the sleeve secured to said housing, and an outboard flange for engagement to the end of the barrel of a spray gun.

5. The spray tip of claim 4 wherein the inboard end of said T-seal is received within an enlarged diameter counterbore of said seal support to transmit axial compression thereto.

6. The spray tip of claim 4 wherein the T-seal is formed of a resilient plastic with its outboard flange in sealing relationship to the end of the barrel of said spray gun.

7. The spray tip of claim 1 wherein a lip member is carried on a raised boss of said housing and an aligned second lip member is also carried on said spray guard body to provide a slot to receive said flange and wherein said flange has radial shoulder means that coact with and abut the opposite sides of said boss to align said transverse bore of said turret member with said longitudinal passageway of said housing.

* * * * *